US009362672B1

(12) United States Patent
Sun

(10) Patent No.: US 9,362,672 B1
(45) Date of Patent: Jun. 7, 2016

(54) LOCKABLE SOCKET

(71) Applicant: Shenzhen Wistek Energy Co., Ltd., Shenzhen (CN)

(72) Inventor: Hui Sun, Shenzhen (CN)

(73) Assignee: Shenzhen Wistek Energy Co., Ltd., Shenzhen (CN)

( * ) Notice: Subject to any disclaimer, the term of this patent is extended or adjusted under 35 U.S.C. 154(b) by 0 days.

(21) Appl. No.: 14/707,502

(22) Filed: May 8, 2015

(30) Foreign Application Priority Data

Jan. 8, 2015 (CN) ..... 2015 2 0010939 U

(51) Int. Cl.
*H01R 13/625* (2006.01)
*H01R 13/639* (2006.01)
*H01R 12/88* (2011.01)

(52) U.S. Cl.
CPC ..... *H01R 13/639* (2013.01); *H01R 12/88* (2013.01); *H01R 13/625* (2013.01)

(58) Field of Classification Search
CPC ..... H01R 13/639; H01R 12/88; H01R 13/71; H01R 33/0854; H01R 35/00; H01R 13/6315
USPC ..... 439/345, 104, 240, 294, 372, 838
See application file for complete search history.

(56) References Cited

U.S. PATENT DOCUMENTS 7,063,556 B1 * 6/2006 Wong ..... H01R 4/2408 439/411
7,347,708 B1 * 3/2008 Huang ..... H01R 13/639 439/263
7,413,456 B1 * 8/2008 DiFusco ..... H01R 33/22 439/253
7,435,112 B1 * 10/2008 Miller ..... H01R 13/502 439/133
8,845,345 B2 * 9/2014 Gattwinkel ..... H01R 13/4534 439/137
8,926,350 B2 * 1/2015 Wolfe ..... H01R 13/58 439/188
9,276,353 B2 * 3/2016 Wolfe ..... H01R 13/58 439/188

* cited by examiner

*Primary Examiner* — Abdullah Riyami
*Assistant Examiner* — Harshad Patel
(74) *Attorney, Agent, or Firm* — Duane Morris LLP

(57) ABSTRACT

The disclosure provides a lockable socket, which includes a body, a rotatable assembly and an prong receiving member. The prong receiving member is provided with a guide hole, a fixing pin is disposed in the guide hole and extends through a first spring. Guide chutes matching with the fixing pins are provided on the inner surface of the body. The lockable socket of the disclosure, which has a simple structure and is easy to use, can effectively prevent the plug including prongs with openings from being released from the socket due to an unexpected external force or a loose connection between the plug and the socket.

7 Claims, 7 Drawing Sheets

LOCKABLE SOCKET

CROSS-REFERENCES TO RELATED APPLICATION

The present application claims priority of Chinese patent application No. 201520010939.6 filed on Jan. 8, 2015 and entitled "Lockable socket", the content of which is incorporated herein by reference in its entirety.

TECHNICAL FIELD

The present disclosure relates to the field of power socket technologies, in particular, to a lockable socket.

TECHNICAL BACKGROUND

Sockets are widely used in daily life, and an existing plug may be directly connected with the socket by inserting metal prongs of the plug into insert holes of the socket. Since the connection between the plug and the socket merely relies on clamping the metal prongs by elastic sheets of the socket, the plug is easy to be released from the socket under an external force, resulting in slipping out of the plug from the socket due to unexpected situations, which not only affects the normal use of an electronic device powered by the socket, but also shorten the service life of the electronic device. In some specific occasions, instruments such as electric drills and electric hammers, which may be frequently moved, will be moved around and manipulated at different angles in use, and hence might likely be powered off due to the release of the plug from the socket, thereby affecting the working efficiency, therefore a security risk exists and there is a need for improvement.

SUMMARY

An object of the present disclosure is to propose a lockable socket which can effectively prevent the plug including prongs with openings from being released from the socket due to an unexpected external force or a loose connection between the plug and the socket, and the lockable socket has a simple structure and is easy to use.

To achieve this object, the disclosure adopts the following technical solutions.

A lockable socket includes a body and a rotatable assembly, the rotatable assembly includes a cover, a base fixedly connected with the cover and prong receiving members located between the cover and the base, the rotatable assembly is disposed inside a cavity of the body and is rotatable relative to the body, the prong receiving member is provided with a guide hole, a fixing pin is disposed in the guide hole and extends through a first spring, and guide chutes matching with the fixing pins are provided on an inner surface of the body; the socket is operatable in such a way that: when a plug including a prong provided with an opening is initially inserted into the socket, a front end of the fixing pin is not in contact with the opening; then the plug is rotated to drive the rotatable assembly to rotate relative to the body, until a rear end of the fixing pin slides along the guide chute to rest against the inner surface of the body, and the fixing pin is moved towards its front end and compresses the first spring, so that the front end of the fixing pin is inserted into the opening of the prong of the plug, thereby locking the plug; when the plug is rotated in a reverse direction to drive the rotatable assembly to rotate relative to the body, until the rear end of the fixing pin is separated from the inner surface of the body and slides within the guide chute, the fixing pin is returned under the action of the first spring, so that the front end of the fixing pin is away from the opening of the prong of the plug, thereby unlocking the plug.

The base is provided with supporting seats for supporting the fixing pins, the support base is provided with a guide groove matching with the fixing pin, the fixing pin is provided with an annular baffle, and one end of the first spring is configured to rest against the baffle while the other end of the first spring is configured to rest against supporting seat.

A stop plate for stopping the fixing pin is provided above the supporting seat, and two positioning columns matching with the stop plate are provided at both sides of the supporting seat, respectively.

The cover includes a panel having a first flange and a second flange between which an annular receiving tank is formed, a second spring is disposed inside the annular receiving tank, the body includes a cylinder, an annular boss is disposed on an inner surface of the cylinder, a lower surface of the boss is flush with that of the cylinder, the guide chutes are provided on an inner surface of the boss, an arc-shaped bump for stopping the second spring is provided on an upper surface of the boss, an outer diameter of the second flange is smaller than an inner diameter of the boss, and one end of the second spring is configured to rest against the panel while the other end of the second spring is configure to rest against the boss.

A stop block is provided on the lower surface of the boss, the base is provided with a third flange, a first stop notch and a second stop notch are provided on an upper surface of the third flange, the second stop notch is configured to receive the stop block; the socket is operatable in such a way that: when the plug including a prong provided with an opening is inserted into the socket and is pressed to drive the rotatable assembly to move downward relative to the body, the second spring is compressed and the second stop notch is moved downward away from the stop block; then the plug is rotated to drive the rotatable assembly to rotate relative to the body, until the first stop notch is moved to a position corresponding to the stop block; the plug is released, and the plug and the rotatable assembly are returned upwards under the action of the second spring, so that the first stop notch is moved upward and thus the stop block is positioned within the first stop notch.

The panel is provided with first fixing columns extending downwards, the base is provided with second fixing columns matching with the first fixing columns, the second fixing column is provided with a counterbore, and the first fixing column is fixedly connected with the second fixing column by a screw.

The cover is provided with insert holes, the positions of which are corresponding to those of the prong receiving members, respectively, and a wiring label is provided at the lower surface of the base.

The beneficial effects of the disclosure lie in that a lockable socket includes a body and a rotatable assembly, the rotatable assembly includes a cover, a base fixedly connected with the cover and prong receiving members located between the cover and the base, the rotatable assembly is disposed inside a cavity of the body and is rotatable relative to the body, the prong receiving member is provided with a guide hole, a fixing pin is disposed in the guide hole and extends through a first spring, guide chutes matching with the fixing pins are provided on an inner surface of the body; the socket is operatable in such a way that: when a plug including a prong provided with an opening is initially inserted into the socket, a front end of the fixing pin is not in contact with the opening; then the plug is rotated to drive the rotatable assembly to rotate relative to the body, until a rear end of the fixing pin slides along the guide chute to rest against the inner surface of the body, and the fixing pin is moved towards its front end and compresses the first spring, so that the front end of the fixing pin is inserted into the opening of the prong of the plug, thereby locking the plug; when the plug is rotated in a reverse direction to drive the rotatable assembly to rotate relative to the body, until the rear end of the fixing pin is separated from the inner surface of the body and slides within the guide chute, the fixing pin is returned under the action of the first spring, so that the front end of the fixing pin is away from the opening of the prong of the plug, thereby unlocking the plug. The lockable socket of the disclosure, which has a simple structure and is easy to use, can effectively prevent the plug including prongs with openings from being released from the socket due to an unexpected external force or a loose connection between the plug and the socket.

A LIST OF THE REFERENCE NUMERALS

1: Body; 11: Cylinder; 12: Boss; 121: Guide Chute;

13: Arc-shaped Bump; 14: Stop Block; 15: Third Fixed Column;

16: Fixing Hole; 17: Notch; 2: Cover; 21: Panel;

22: First Flange; 23: Second Flange; 24: First Fixing Column;

25: Insert Hole; 3: Base; 31: Supporting Seat;

311: Guide Groove; 32: Positioning Column; 33: Third Flange;

331: First Stop Notch; 332: Second Stop Notch; 34: Second Fixing Column;

35: Wiring Label; 4: Prong Receiving Member; 41: Guide Hole;

5: Fixing Pin; 51: Baffle; 52: Front End of Fixing Pin

6: First Spring; 7: Stop Plate; 8: Second Spring.

DETAILED DESCRIPTION OF THE PREFERRED EMBODIMENT

The technical solutions of the present disclosure will be further described by way of embodiments below in conjunction with FIGS. 1 to 10.

The First Embodiment

Figure 1:
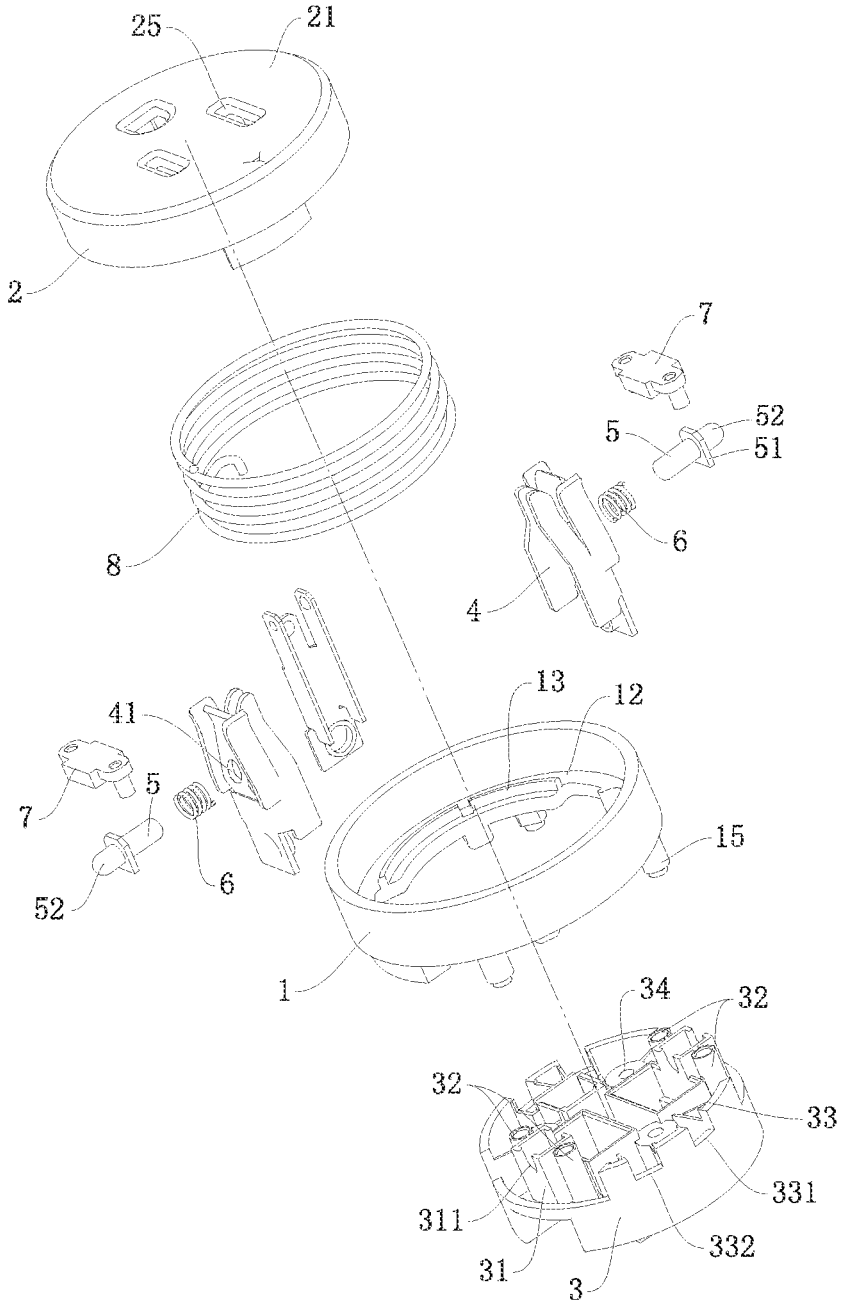
FIG. 1 is a schematic perspective exploded view of a lockable socket in the present disclosure.
Figure 2:
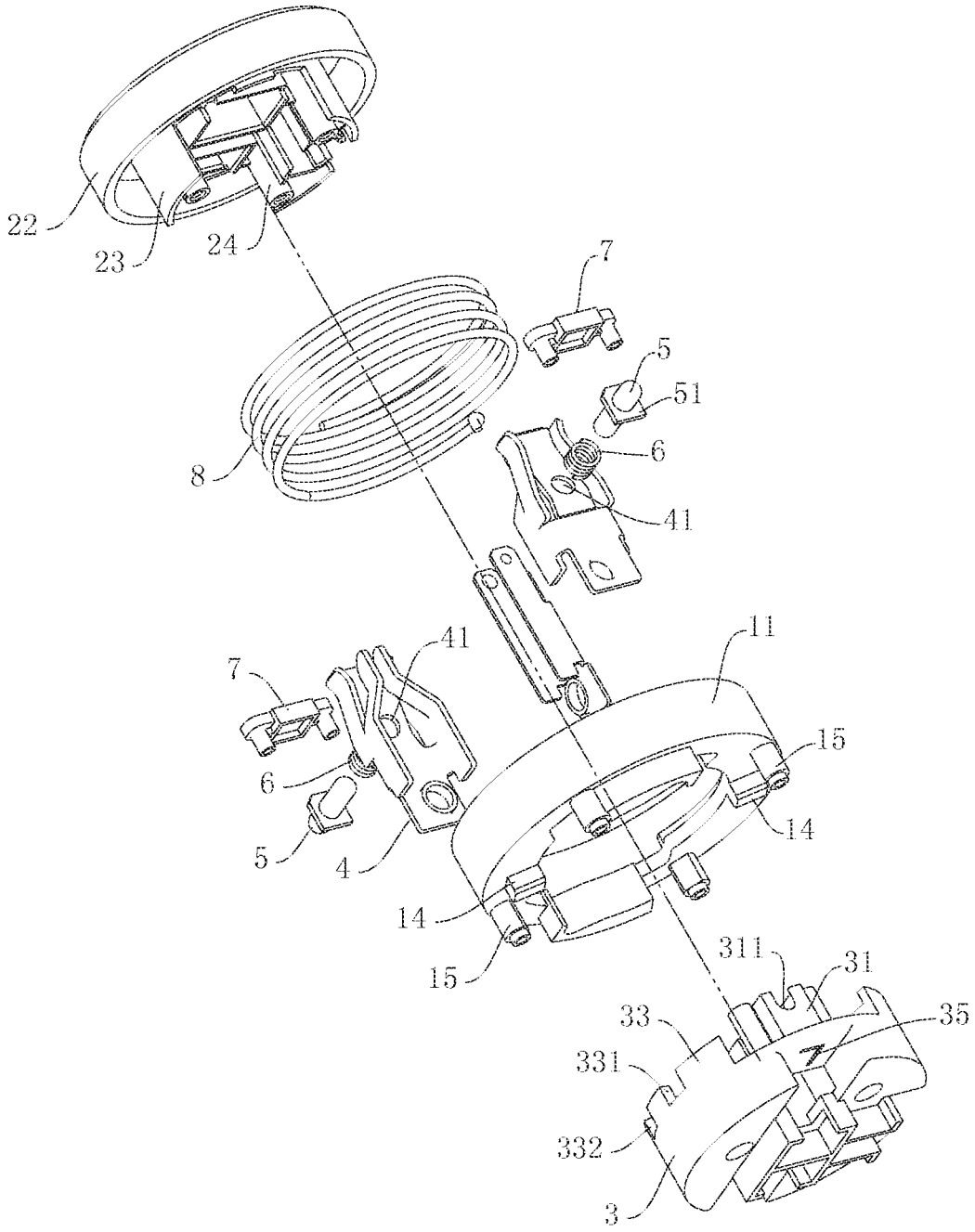
FIG. 2 is a perspective exploded view of the lockable socket in the present disclosure in another direction.
Figure 4:
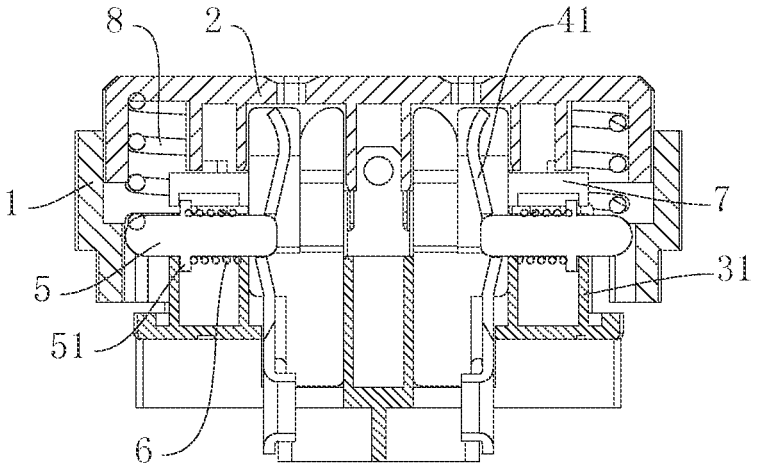
FIG. 4 is a sectional view of the lockable socket taken along a section line A-A in FIG. 3.
Figure 5:
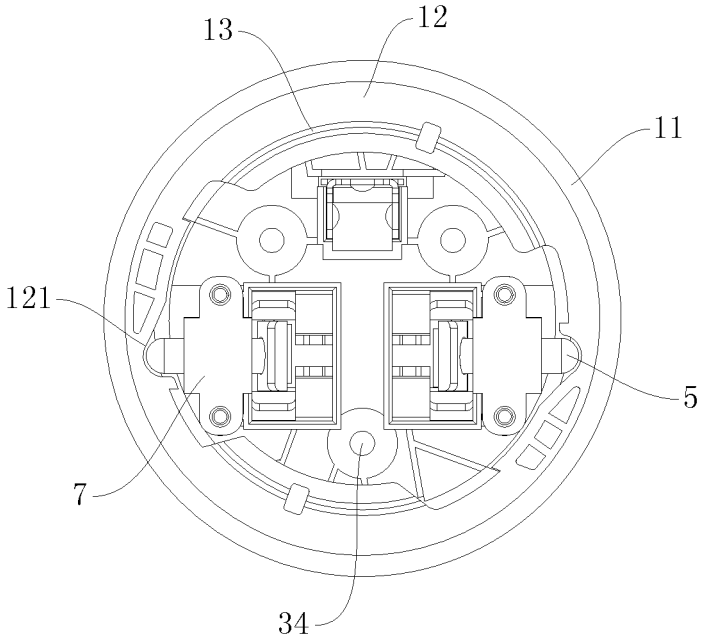
FIG. 5 is a schematic diagram showing an internal configuration of the lockable socket shown in FIG. 3, but a cover and a second spring has been removed.
Figure 6:
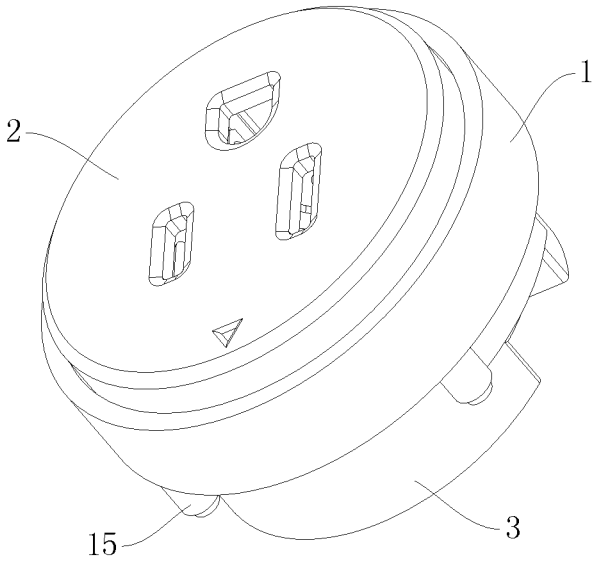
FIG. 6 is a perspective structural view of the lockable socket in the present disclosure.

A lockable socket includes a body 1 and a rotatable assembly. The rotatable assembly includes a cover 2, a base 3 fixedly connected with the cover 2, and prong receiving members 4 located between the cover 2 and the base 3. The rotatable assembly is disposed inside a cavity of the body 1 and is rotatable relative to the body 1. The prong receiving member 4 is provided with a guide hole 41, in which a fixing pin 5 is disposed. In an implementation, a front end 52 of the fixing pin 5 is designed as a smooth round head, the fixing pin 5 extends through a first spring 6, and guide chutes 121 matching with the fixing pins 5 are provided on the inner surface of the body 1, as shown in FIGS. 1, 2 and 6. The base 3 is provided with supporting seats 31 for supporting the fixing pins 5, and the support base 31 is provided with a guide groove 311 matching with the fixing pin 5, as shown in FIGS. 1 and 2. The fixing pin 5 is provided with an annular baffle 51, one end of the first spring 6 rests against the baffle 51 while the other end thereof rests against the supporting seat 31, as shown in FIG. 4. A stop plate 7 for restraining the fixing pin 5 is provided above the supporting seat 31, and two positioning columns 32 matching with the stop plate 7 are provided at both sides of the supporting seat 31, respectively, as shown in FIGS. 4 and 5.

The stop plate 7 cooperates with the supporting seat 31 to limit the radial movement of the fixing pin 5. The annular baffle 51 provided on the fixing pin 5 rests against the supporting seat 31, the stop plate 7 and the first spring 6, as shown in FIG. 4. The provision of the first spring 6 enables the fixing pin 5 to be movable towards the front end 52 of the fixing pin 5 under an external force and returned in a reverse direction.

Figure 7:
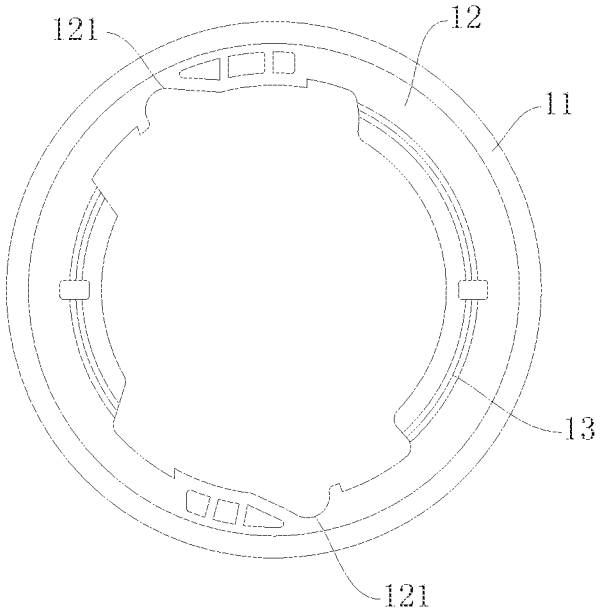
FIG. 7 is a front view of a body of the lockable socket in the present disclosure.
Figure 8:
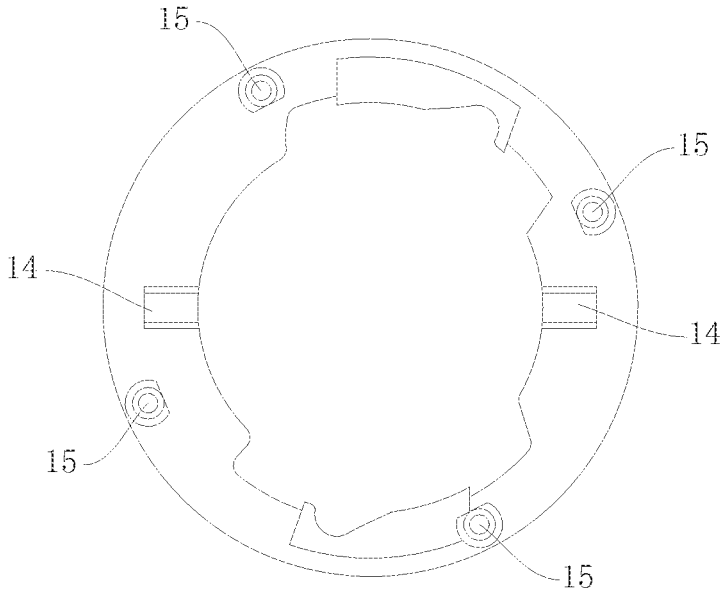
FIG. 8 is a rear view of the body of the lockable socket in the present disclosure.

In this embodiment, the cover 2 includes a panel 21 having a first flange 22 and a second flange 23. An annular receiving tank is formed between the first flange 22 and the second flange 23, and a second spring 8 is disposed inside the annular receiving tank, as shown in FIGS. 1, 2 and 4. The body 1 includes a cylinder 11, and an annular boss 12 is disposed on the inner surface of the cylinder 11 in the inner cavity of the cylinder 11. The lower surface of the boss 12 is flush with that of the cylinder 11, and the guide chutes 121 are provided on the inner surface of the boss 12, as shown in FIGS. 7 and 8. In an implementation, the guide chute 121 is a smooth curved chute so that the fixing pin 5 can more easily slide off the guide chute 121, thus facilitating the operation.

In this embodiment, an arc-shaped bump 13 for stopping a second spring 8 is provided on the upper surface of the boss 12, as shown in FIGS. 1 and 7. The outer diameter of the second flange 23 is smaller than the inner diameter of the boss 12, and one end of the second spring 8 rests against the panel 21 while the other end thereof rests against the boss 12, as shown in FIG. 4. Stop blocks 14 are provided on the lower surface of the boss 12, as shown in FIGS. 2 and 8. The base 3 is provided with a third flange 33, and a first stop notch 331 and a second stop notch 332 are provided at the upper surface of the third flange 33, as shown in FIGS. 1 and 2. The stop blocks 14 are located within the second stop notch 332. As such, the stop blocks 14, the first stop notch 331 and the second stop notch 332 form a rotatable stop structure.

The operations of the socket according to the present embodiment are described below. When the plug including a prong provided with an opening is initially inserted into the socket, the front end 52 of the fixing pin 5 is not in contact with the opening; then, the plug is pressed down, causing the rotatable assembly to move downward relative to the body 1, so that the second spring 8 is compressed and the second stop notch 332 is moved downward away from the stop block 14; the plug is rotated to drive the rotatable assembly to rotate relative to the body 1, until the rear end of the fixing pin 5 slides along the guide chute 121 to rest against the inner surface of the body 1, and the fixing pin 5 is moved towards its front end 52 and compresses the first spring 6, so that the front end 52 of the fixing pin 5 is inserted into the opening of the prong of the plug, thereby locking the plug, at this time, the first stop notch 331 has been moved to a position corresponding to the stop block 14; subsequently, the plug is released, and the plug and the rotatable assembly are returned back upwards under the action of the second spring 8, so that the first stop notch 331 is moved upward and hence the stop block 14 is positioned within the first stop notch 331, thus the locking of the plug to the socket is completed; to remove the plug from the socket, the plug is pressed downward to drive the rotatable assembly to move downward relative to the body, so that the second spring 8 is compressed and the first stop notch 331 is moved downward away from the stop block 14; when the plug is rotated in a reverse direction (which is opposite to the direction in which the plug is rotated to be locked in the socket) to drive the rotatable assembly to rotate relative to the body, until the rear end of the fixing pin 5 is separated from the inner surface of the body 1 and slides within the guide chute 121, the fixing pin 5 is returned under the action of the first spring 6, so that the front end 52 of the fixing pin 5 is away from the opening of the prong of the plug, thereby unlocking the plug, at this time, the second stop notch 332 has been moved to the position corresponding to the stop block 14; the plug is released, and the plug and the rotatable assembly are returned back upwards under the action of the second spring 8, so that the second stop notch 332 is moved upward and hence the stop block 14 is positioned within the second stop notch 332, thus completing the unlocking of the plug. The socket of the present disclosure, which has a simple structure and is easy to use, can effectively prevent the plug including prongs with openings from being released from the socket due to an unexpected external force or a loose connection between the plug and the socket.

In this embodiment, there are two prong receiving members 4, which are connected to the hot and neutral lines, respectively, and are symmetrically arranged. The number of the fixing pins 5, as well as the number of the slide chutes 121, is equal to the number of the prong receiving members 4. In an implementation, the socket of the disclosure also includes a grounding prong receiving member.

Figure 9:
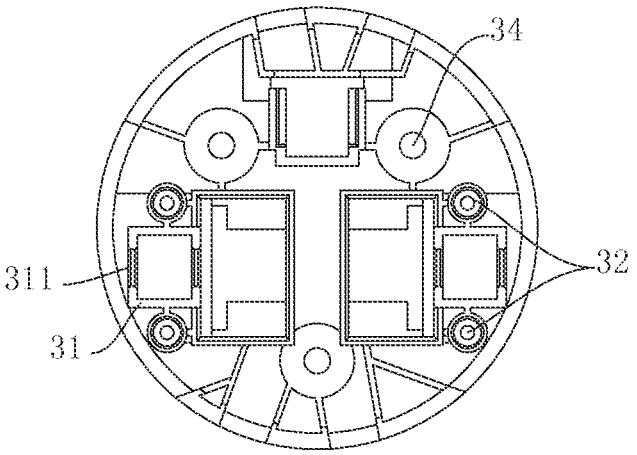
FIG. 9 is a front view of a base of the lockable socket in the present disclosure.

In this embodiment, the panel 21 is provided with first fixing columns 24 extending downwards, as shown in FIG. 2. The base 3 is provided with second fixing columns 34 matching with the first fixing columns 24, as shown in FIGS. 1 and 9. The second fixing column 34 is provided with a counterbore, and the first fixing column 24 may be fixedly connected with the second fixing column 34 by a screw. As such, the panel 21 and the base 3 fixedly connected by screws can be conveniently released from each other.

Figure 3:
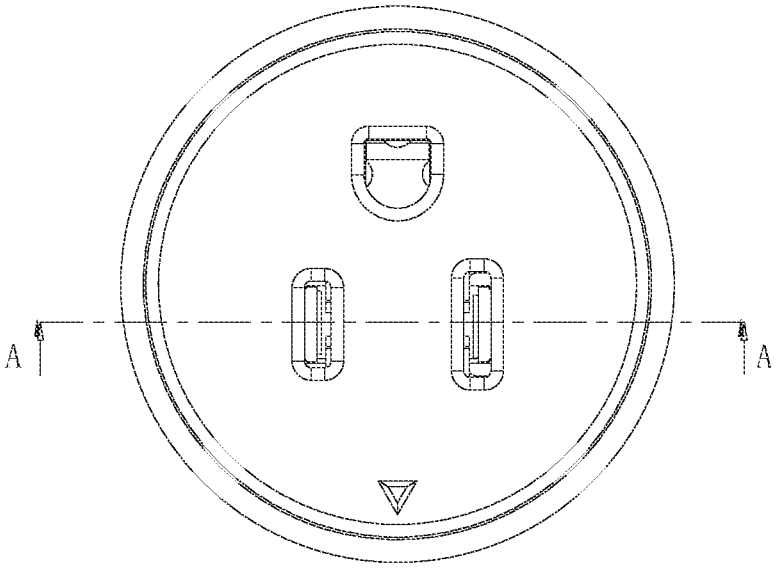
FIG. 3 is a front view of the lockable socket in the present disclosure.
Figure 10:
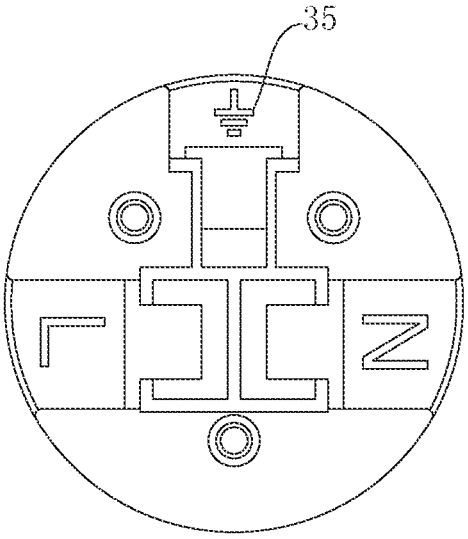
FIG. 10 is a rear view of the base of the lockable socket in the present disclosure.

In this embodiment, the cover 2 is provided with insert holes 25 at positions corresponding to the positions of the prong receiving members 4, as shown in FIGS. 1 to 3. The lower surface of the base 3 is provided with wiring labels 35, as shown in FIGS. 2 and 10. The positions of the insert holes 25 are corresponding to those of the prong receiving members 4, respectively, to ensure that the prongs of the plug can effectively cooperate with the prong receiving members 4 after being inserted into the insert holes 25. In an implementation, the cover 2 is also provided with a grounding insert hole corresponding to the grounding prong receiving member. The provision of the wiring labels 35 on the lower surface of the base 3 makes the use of the socket easier and improves the installation efficiency of the socket.

Figure 11:
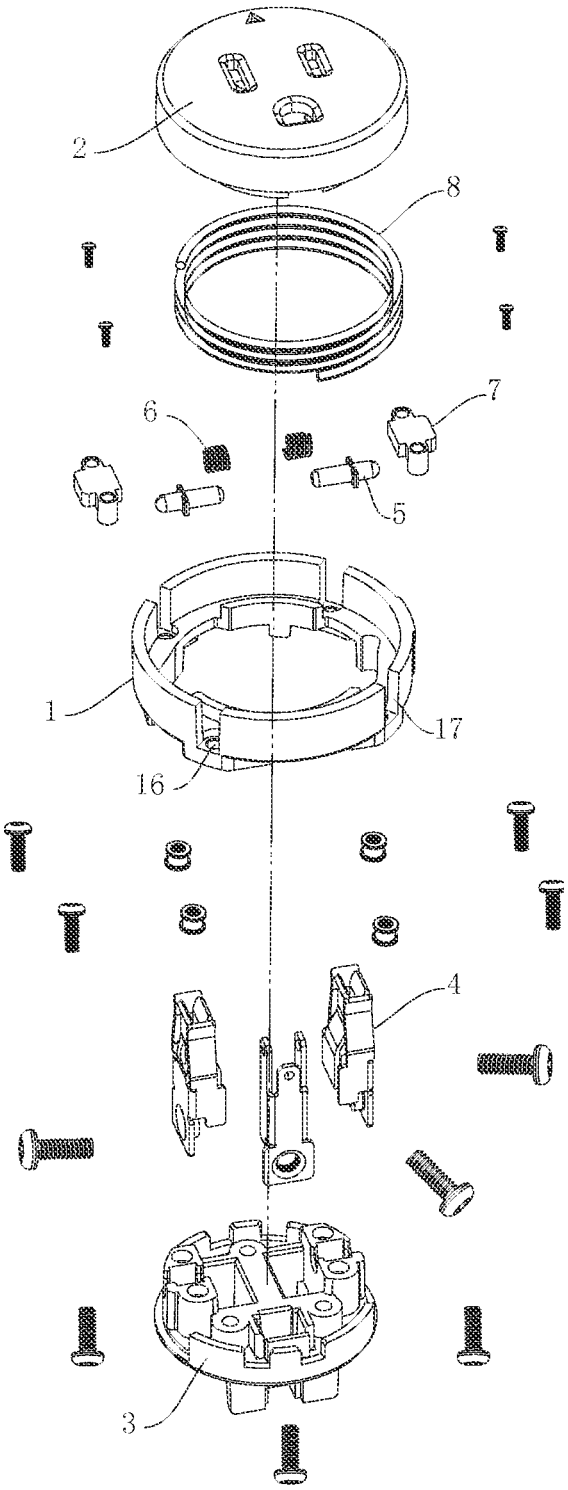
FIG. 11 is a schematic perspective exploded view of a lockable socket according to another embodiment of the present invention.

In this embodiment, third fixing columns 15 for fixing the body 1 are provided on the lower surface of the boss 12, as shown in FIGS. 2 and 8. The third fixing columns 15 can be connected to a wall, a power strip and the like to fix the body 1. In other embodiments, fixing holes 16 for fixing the body 1 are provided on the lower surface of the boss 12, and notches 17 are provided on the cylinder 11 at positions corresponding to the fixing holes 16, as shown in FIG. 11. The body 1 can be fixed to the wall, the power strip and the like through the fixing holes 16 and the notches 17.

The Second Embodiment

The second embodiment is different from the first embodiment in that the second spring 8 and the rotatable stop structure, which includes the stop block 14, the first stop notch 331 and the second stop notch 332 in the first embodiment, are omitted. That is, a press-rotation locking structure is changed into a direct-rotation locking structure.

The operations of the socket according to the present embodiment are described as follows. When the plug including prongs with openings is initially inserted into the socket, the front end 52 of the fixing pin 5 is not in contact with the opening; then the plug is rotated to drive the rotatable assembly to rotate relative to the body 1, until the rear end of the fixing pin 5 slides along the guide chute 121 to rest against the inner surface of the body 1, that is, the inner surface of the body 1 stops the axial movement of the fixing pin 5, and the fixing pin 5 is moved towards its front end 52 and compresses the first spring 6, so that the front end 52 of the fixing pin 5 is inserted into the opening of the prong, thereby locking the plug; when the plug is rotated in the reverse direction to drive the rotatable assembly to rotate relative to the body 1, until the rear end of the fixing pin 5 is separated from the inner surface of the body 1 and slides within the guide chute 121, the fixing pin 5 is returned under the action of the first spring 6, so that the front end 52 of the fixing pin 5 is away from the opening, thereby unlocking the plug. The socket of the present disclosure, which has a simple structure and is easy to use, can effectively prevent the plug including prongs with openings from being released from the socket due to an unexpected external force or a loose connection between the plug and the socket.

The lockable socket of the present disclosure, which is simple to manipulate and easy to install, can cooperate with any plug including prongs with openings, to effectively lock and unlock the plug including prongs with openings, thus preventing malfunctions of electrical appliances due to the loosening of the plug from the socket. Further, a user is allowed to choose either the locking structure in the first embodiment or the locking structure in the second embodiment as desired.

The some preferred embodiments of the present invention have been described as above. It readily occurs to those skilled in the art that changes can be made to the embodiments and applications of the present disclosure in light of the concept of the present disclosure, and the present disclosure should not be limited to the above-described embodiments.

The invention claimed is:

1. A lockable socket comprising a body (1) and a rotatable assembly, wherein the rotatable assembly comprises a cover (2), a base (3) fixedly connected with the cover (2), and prong receiving members (4) located between the cover (2) and the base (3), wherein, the rotatable assembly is disposed inside a cavity of the body (1) and is rotatable relative to the body (1), the prong receiving member (4) is provided with a guide hole (41), a fixing pin (5) is disposed in the guide hole (41) and extends through a first spring (6), and guide chutes (121) matching with the fixing pins (5) are provided on an inner surface of the body (1);

the socket is operatable in such a way that: when a plug including a prong provided with an opening is initially inserted into the socket, a front end of the fixing pin (5) is not in contact with the opening; then the plug is rotated in a first direction to drive the rotatable assembly to rotate relative to the body (1), until a rear end of the fixing pin (5) slides along the guide chute (121) to rest against the inner surface of the body (1), and the fixing pin (5) is moved towards its front end and compresses the first spring (6), so that the front end of the fixing pin (5) is inserted into the opening of the prong of the plug, thereby locking the plug; when the plug is rotated in a second direction in reverse to the first direction to drive the rotatable assembly to rotate relative to the body (1), until the rear end of the fixing pin (5) is separated from the inner surface of the body (1) and slides within the guide chute (121), the fixing pin (5) is returned under the action of the first spring (6), so that the front end of the fixing pin (5) is away from the opening of the prong of the plug, thereby unlocking the plug.

2. The lockable socket according to claim 1, wherein the base (3) is provided with supporting seats (31) for supporting the fixing pins (5), the support base (31) is provided with a guide groove (311) matching with the fixing pin (5), the fixing pin (5) is provided with an annular baffle (51), and one end of the first spring (6) is configured to rest against the baffle (51) while the other end of the first spring (6) is configured to rest against supporting seat (31).

3. The lockable socket according to claim 2, wherein a stop plate (7) for stopping the fixing pin (5) is provided above the supporting seat (31), and two positioning columns (32) matching with the stop plate (7) are provided at both sides of the supporting seat (31), respectively.

4. The lockable socket according to claim 1, wherein the cover (2) comprises a panel (21) having a first flange (22) and a second flange (23) between which an annular receiving tank is formed, a second spring (8) is disposed inside the annular receiving tank, the body (1) comprises a cylinder (11), an annular boss (12) is disposed on an inner surface of the cylinder (11), a lower surface of the boss (12) is flush with that of the cylinder (11), the guide chutes (121) are provided on an inner surface of the boss (12), an arc-shaped bump (13) for stopping the second spring (8)*is* provided on an upper surface of the boss (12), an outer diameter of the second flange (23) is smaller than an inner diameter of the boss (12), and one end of the second spring (8) is configured to rest against the panel (21) while the other end of the second spring (8) is configured to rest against the boss (12).

5. The lockable socket according to claim 4, wherein a stop block (14) is provided on the lower surface of the boss (12), the base (3) is provided with a third flange (33), a first stop notch (331) and a second stop notch (332) are provided on an upper surface of the third flange (33), the second stop notch (332) is configured to receive the stop block (14);

wherein the socket is operatable in such a way that: when the plug including a prong provided with an opening is inserted into the socket and is pressed to drive the rotatable assembly to move downward relative to the body (1), the second spring (8) is compressed and the second stop notch (332) is moved downward away from the stop block (14); then the plug is rotated to drive the rotatable assembly to rotate relative to the body (1), until the first stop notch (331) is moved to a position corresponding to the stop block (14); the plug is released, and the plug and the rotatable assembly are returned upwards under the action of the second spring (8), so that the first stop notch (331) is moved upward and thus the stop block (14) is positioned within the first stop notch (331).

6. The lockable socket according to claim 4, wherein the panel (21) is provided with first fixing columns (24) extending downwards, the base (3) is provided with second fixing columns (34) matching with the first fixing columns (24), the second fixing column (34) is provided with a counterbore, and the first fixing column (24) is fixedly connected with the second fixing column (34) by a screw.

7. The lockable socket according to claim 1, wherein the cover (2) is provided with insert holes (25), the positions of which are corresponding to those of the prong receiving members (4), respectively, and a wiring label (35) is provided at the lower surface of the base (3).

* * * * *